US012383799B2

(12) United States Patent
Blink et al.

(10) Patent No.: US 12,383,799 B2
(45) Date of Patent: Aug. 12, 2025

(54) GOLF BALLS HAVING UNIQUE EFFECT PIGMENTS IN ONE OR MORE LAYERS

(71) Applicant: Acushnet Company, Fairhaven, MA (US)

(72) Inventors: Robert Blink, Fairhaven, MA (US); Manjari Kuntimaddi, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 96 days.

(21) Appl. No.: 18/081,234

(22) Filed: Dec. 14, 2022

(65) Prior Publication Data

US 2024/0198183 A1 Jun. 20, 2024

(51) Int. Cl.
*A63B 37/06* (2006.01)
*A63B 37/00* (2006.01)

(52) U.S. Cl.
CPC .. *A63B 37/00223* (2020.08); *A63B 37/00221* (2020.08)

(58) Field of Classification Search
CPC ..... A63B 37/00373
See application file for complete search history.

(56) References Cited

U.S. PATENT DOCUMENTS 5,427,378 A * 6/1995 Murphy ..... A63B 43/06 473/378
2004/0266555 A1* 12/2004 Park ..... A63B 37/0003 473/371
2009/0137343 A1* 5/2009 Morgan ..... A63B 43/06 473/378
2014/0250609 A1* 9/2014 Tutmark ..... A63B 37/00221 8/515

* cited by examiner

*Primary Examiner* — Raeann Gorden
(74) *Attorney, Agent, or Firm* — Loeb & Loeb LLP

(57) ABSTRACT

A golf ball includes a composition producing a unique visible effect to enhance a performance parameter of the golf ball. The golf ball includes a color-shifting cover surrounding a core. The color-shifting cover includes a cover material mixed with a colorant. The cover material includes at least one of a thermoset polyurethane, cast urethane, or ionomer material. The colorant includes one or more of a flake, pigment, or dye. The color-shifting cover includes a visible shift in color based on a change in at least one of incidence of light, temperature, or pressure.

13 Claims, 2 Drawing Sheets

GOLF BALLS HAVING UNIQUE EFFECT PIGMENTS IN ONE OR MORE LAYERS

FIELD OF THE INVENTION

The present disclosure relates generally to the field of golf balls, and more specifically, to golf balls with one or more uniquely-pigmented layers producing thermochromic, photochromic, and/or other similar effects.

BACKGROUND OF THE INVENTION

The background description provided herein is for the purpose of generally presenting the context of the disclosure. The work of the presently named inventors, to the extent it is described in this background section, as well as aspects of the description that may not otherwise qualify as prior art at the time of filing, are neither expressly nor impliedly admitted as prior art against the present disclosure.

This disclosure relates to thermochromic and photochromic colorants, such flakes, pigments, dyes, or other materials that fall within these categories (e.g., inks, paints), used in golf balls. Thermochromic materials such as inks typically comprise an electron-donating chromogenic substance, an electron-accepting substance, and a solvent which undergo a reversible color change in response to a change in the ambient temperature, for example, from ambient to freezing or from ambient to elevated temperatures. The color change which takes place may be a change from one color to another, from colored to colorless, or from colorless to colored. Thermochromic inks have frequently been used to provide security features on documents such as checks and other business forms. For example, documents may be provided with an area or areas which will change color upon exposure to a temperature change such that the authenticity of the document may be verified or so that anti-copy protection is provided.

Documents printed with thermochromic inks are often subsequently imaged with non-impact printers such as laser, ink jet, and ion deposition printers or impact printers to provide variable or non-variable information. However, a problem has existed with using photochromic and thermochromic inks and paints in golf equipment as it has been difficult to achieve satisfactory toner bonding on golf balls and other golf equipment. And, because of the lack of strong adherence of this toner to golf equipment, an unmet need exists to accomplish successful adherence of photochromic and thermochromic inks to golf equipment. Therefore, it would be desirable to be able to provide thermochromic and photochromic compositions on golf equipment, and particularly on golf balls.

Photochromic and thermochromic ink formulations are known in the patent literature, primarily for screen printing applications but also for security inks. By way of example, U.S. Pat. No. 5,591,255 issued to Small et al. describes thermochromic ink formulations and their methods of use. U.S. Pat. No. 5,017,225, issued to Nakanishi et al. describes microencapsulated photochromic material, together with a process for its preparation in a water-base ink composition. U.S. Pat. No. 4,927,180, issued to Trundle et al describes marking of articles with photochromic compounds. U.S. Pat. No. 5,630,869 issued to Amon et al describes reversibly photochromic printing inks. U.S. Pat. No. 7,351,362 issued to Yasuda et al. describes various photochromic materials.

Fluorescent ink formulations most often pertain to ink jet inks, but are also used for security applications. By way of example, U.S. Pat. No. 4,150,997, issued to Hayes describes a water base fluorescent ink for ink jet printing, U.S. Pat. No. 5,256,192, issued to Liu et al. describes a solvent based fluorescent ink composition for inkjet printing. U.S. Pat. No. 7,141,105 issued to Udagawa et al. describes a water-based fluorescent ink, a recorded image using the ink, and a judging method.

Thus, while thermochromic and photochromic inks are known in the art, it is not a simple matter of printing these inks on the surface of golf balls in order to produce a thermochromic or photochromic golf ball. The present disclosure describes golf balls having cover layers and methods for making covers for golf balls having many advantageous features and benefits, such as photochromism and thermochromism. The disclosure also includes the resulting golf balls having good physical and playing performance properties.

SUMMARY OF THE INVENTION

According to some embodiments, a golf ball has a color-shifting cover surrounding a core. The color-shifting cover has a cover material mixed with a colorant. The cover material has at least one of a thermoset polyurethane, cast urethane, or ionomer material. The colorant is one or more of a flake, pigment, or dye. The color-shifting cover has a visible shift in color based on a change in at least one of incidence of light, temperature, or pressure.

According to some embodiments, a golf ball has a thermochromic ink composition with effect pigments, wherein the thermochromic ink composition includes a thermochromic slurry; and a thermochromic ink.

According to some other embodiments, a golf ball has a photochromic ink composition with effect pigments, wherein the photochromic ink composition comprises one or more photochromic units including azobenzene, diarylethene, phenoxynaphthacenequinone, spiropyran, or spirooxazine.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION OF THE INVENTION

Figure 1:
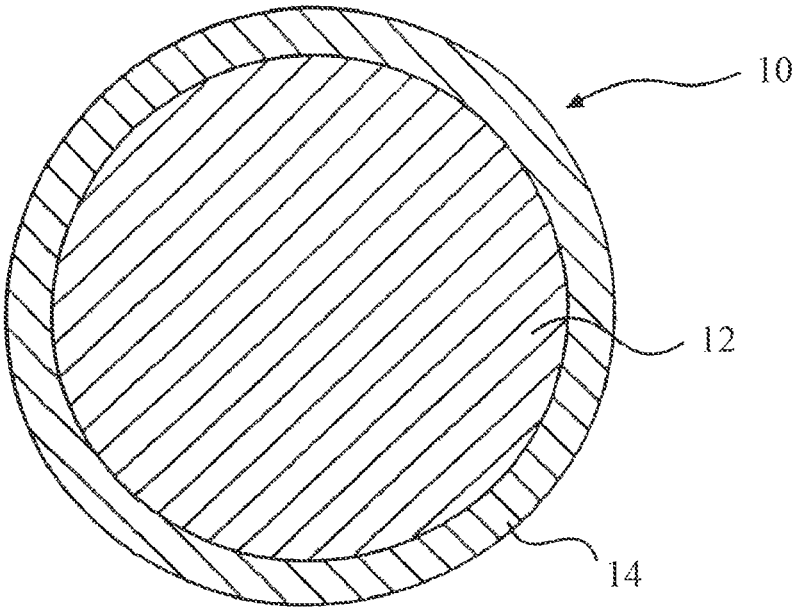
FIG. 1 is a cross-sectional view of a two-piece golf ball in accordance with an embodiment of the present disclosure.

The present disclosure generally relates to golf balls having one or more layers comprising thermochromic and/or photochromic pigment compositions. The term pigment, as used herein, generally refers to a colorant of some form, which can take the form of a flake or dye, or other material which is best described itself as a pigment. A colorant, as used herein, may be one or more of a flake, pigment, or dye. Inks and paints can be considered as falling into one or more of the pigment or dye category and thus can also be colorants as used herein. The disclosure includes methods for applying colorants to a golf ball cover during a manufacturing process. Golf balls consistent with the present disclosure include two or more layers, with at least one cover layer and a single- or multi-layered core.

The present disclosure includes at least one layer that comprises a unique-effect pigment. The unique-effect pigment may be a colorant in the form of one or more of a flake, pigment, or dye added to a cover material during a manufacturing process. Examples of cover layers that may serve as a substrate or base for a unique-effect pigment layer are further described in the below section. The resulting golf ball may include an integrated photochromic and/or thermochromic effect that enhances one or more golf ball performance properties, such as identification, visualization, alignment, or the like. Disclosed embodiments including unique-effect pigments may produce a color-shifting appearance.

Cover Layer

Golf balls consistent with the present disclosure include an outer cover layer. The outer cover layer includes at least one cover material. The cover material may be a thermoset polyurethane, a cast urethane, or an ionomer material.

In one embodiment, the cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

In one example, the outer cover layer may be made of a thermoplastic polyurethane composition. In general, polyurethanes contain urethane linkages formed by reacting an isocyanate group (—N═C═O) with a hydroxyl group (OH). The polyurethanes are produced by the reaction of a multi-functional isocyanate (NCO—R—NCO) with a long-chain polyol having terminal hydroxyl groups (OH—OH) in the presence of a catalyst and other additives. The chain length of the polyurethane prepolymer is extended by reacting it with short-chain diols (OH—R'—OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

By the term, "isocyanate compound" as used herein, it is meant any aliphatic or aromatic isocyanate containing two or more isocyanate functional groups. The isocyanate compounds can be monomers or monomeric units, because they can be polymerized to produce polymeric isocyanates containing two or more monomeric isocyanate repeat units. The isocyanate compound may have any suitable backbone chain structure including saturated or unsaturated, and linear, branched, or cyclic. These isocyanate compounds also can be referred to as polyisocyanates or multi-functional isocyanates. By the term, "polyamine" as used herein, it is meant any aliphatic or aromatic compound containing two or more primary or secondary amine functional groups. The polyamine compound may have any suitable backbone chain structure including saturated or unsaturated, and linear, branched, or cyclic. The term "polyamine" may be used interchangeably with amine-terminated component. These polyamines also can be referred to as amine compounds or multi-functional amines. By the term, "polyol" as used herein, it is meant any aliphatic or aromatic compound containing two or more hydroxyl functional groups. The term "polyol" may be used interchangeably with hydroxy-terminated component. By the term, "polyimine compound", it is meant it is meant any aliphatic or aromatic compound containing two or more imine functional groups. These polyimines also can be referred to as imine compounds or multi-functional imines.

Thermoplastic polyurethanes have minimal cross-linking; any bonding in the polymer network is primarily through hydrogen bonding or other physical mechanism. Because of their lower level of cross-linking, thermoplastic polyurethanes are relatively flexible. The cross-linking bonds in thermoplastic polyurethanes can be reversibly broken by increasing temperature such as during molding or extrusion. That is, the thermoplastic material softens when exposed to heat and returns to its original condition when cooled. On the other hand, thermoset polyurethanes become irreversibly set when they are cured. The cross-linking bonds are irreversibly set and are not broken when exposed to heat. Thus, thermoset polyurethanes, which typically have a high level of cross-linking, are relatively rigid.

Commercially-available examples of suitable thermoplastic polyurethanes that can be used in accordance with this invention include TPUs sold under the tradenames of Texin® 250, Texin® 255, Texin® 260, Texin® 270, Texin®950U, Texin® 970U, Texin®1049, Texin@990DP7-1191, Texin® DP7-1202, Texin®990R, Texin®993, Texin®DP7-1049, Texin® 3203, Texin® 4203, Texin® 4206, Texin® 4210, Texin® 4215, and Texin® 3215, each commercially available from Covestro LLC, Pittsburgh PA; Estane® 50 DT3, Estane®58212, Estane®55DT3, Estane®58887, Estane®EZ14-23A, Estane®ETE 50DT3, each commercially available from Lubrizol Company of Cleveland, Ohio; and Elastollan®WY1149, Elastollan®1154D53, Elastollan®1180A, Elastollan®1190A, Elastollan®1195A, Elastollan®1185AW, Elastollan®1175AW, each commercially available from BASF; Desmopan® 453, commercially available from Bayer of Pittsburgh, PA, and the E-Series TPUs, such as D 60 E 4024 commercially available from Huntsman Polyurethanes of Germany.

Aromatic polyurethanes can be prepared in accordance with this invention and these materials are preferably formed by reacting an aromatic diisocyanate with a polyol. Suitable aromatic diisocyanates that may be used in accordance with this invention include, for example, toluene 2,4-diisocyanate (TDI), toluene 2,6-diisocyanate (TDI), 4,4'-methylene diphenyl diisocyanate (MDI), 2,4'-methylene diphenyl diisocyanate (MDI), polymeric methylene diphenyl diisocyanate (PMDI), p-phenylene diisocyanate (PPDI), m-phenylene diisocyanate (PDI), naphthalene 1,5-diisocynate (NDI), naphthalene 2,4-diisocyanate (NDI), p-xylene diisocyanate (XDI), and homopolymers and copolymers and blends thereof. The aromatic isocyanates are able to react with the hydroxyl or amine compounds and form a durable and tough polymer having a high melting point. The resulting polyurethane generally has good mechanical strength and cut/shear-resistance.

Aliphatic polyurethanes also can be prepared in accordance with this invention and these materials are preferably formed by reacting an aliphatic diisocyanate with a polyol. Suitable aliphatic diisocyanates that may be used in accordance with this invention include, for example, isophorone diisocyanate (IPDI), 1,6-hexamethylene diisocyanate (HDI), 4,4'-dicyclohexylmethane diisocyanate ("$H_{12}$ MDI"), meta-tetramethylxylyene diisocyanate (TMXDI), trans-cyclohexane diisocyanate (CHDI), and homopolymers and copolymers and blends thereof. Particularly suitable multifunctional isocyanates include trimers of HDI or $H_{12}$ MDI, oligomers, or other derivatives thereof. The resulting polyurethane generally has good light and thermal stability.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG) which is particularly preferred, polyethylene propylene glycol, polyoxypropylene glycol, and mixtures thereof. The hydrocarbon chain can have saturated or unsaturated bonds and substituted or unsubstituted aromatic and cyclic groups.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

There are two basic techniques that can be used to make the polyurethanes: a) one-shot technique, and b) prepolymer technique. In the one-shot technique, the diisocyanate, polyol, and hydroxyl-terminated chain-extender (curing agent) are reacted in one step. On the other hand, the prepolymer technique involves a first reaction between the diisocyanate and polyol compounds to produce a polyurethane prepolymer, and a subsequent reaction between the prepolymer and hydroxyl-terminated chain-extender. As a result of the reaction between the isocyanate and polyol compounds, there will be some unreacted NCO groups in the polyurethane prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

Either the one-shot or prepolymer method may be employed to produce the polyurethane compositions of the invention. In one embodiment, the one-shot method is used, wherein the isocyanate compound is added to a reaction vessel and then a curative mixture comprising the polyol and curing agent is added to the reaction vessel. The components are mixed together so that the molar ratio of isocyanate groups to hydroxyl groups is preferably in the range of about 1.00:1.00 to about 1.10:1.00. In a second embodiment, the prepolymer method is used. In general, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single chain-extender or blend of chain-extenders as described further below. As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. In general, thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio A catalyst may be employed to promote the reaction between the isocyanate and polyol compounds for producing the prepolymer or between prepolymer and chain-extender during the chain-extending step. Preferably, the catalyst is added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol (PTMEG), preferably having a molecular weight from about 250 to about 3900; and mixtures thereof.

Suitable amine chain-extending (curing) agents that can be used in chain-extending the polyurethane prepolymer include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl 4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"); and mixtures thereof. One particularly suitable amine-terminated chain-extending agent is Ethacure 300™ (dimethylthiotoluenediamine or a mixture of 2,6-diamino-3,5-dimethylthiotoluene and 2,4-diamino-3,5-dimethylthiotoluene.) The amine curing agents used as chain extenders normally have a cyclic structure and a low molecular weight (250 or less).

When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

More particularly, when the polyurethane prepolymer is reacted with hydroxyl-terminated curing agents during the chain-extending step, as described above, the resulting composition is essentially a pure polyurethane composition containing urethane linkages having the following general structure:

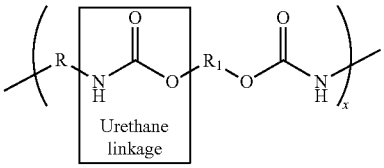

where x is the chain length, i.e., about 1 or greater, and R and $R_1$ are straight chain or branched hydrocarbon chain having about 1 to about 20 carbons.

However, when the polyurethane prepolymer is reacted with an amine-terminated curing agent during the chain-extending step, any excess isocyanate groups in the prepolymer will react with the amine groups in the curing agent and create urea linkages having the following general structure:

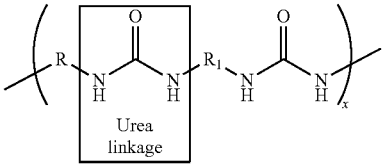

where x is the chain length, i.e., about 1 or greater, and R and $R_1$ are straight chain or branched hydrocarbon chain having about 1 to about 20 carbons.

The polyurethane compositions used to form the cover layer may contain other polymer materials including, for example: aliphatic or aromatic polyurethanes, aliphatic or aromatic polyureas, aliphatic or aromatic polyurethane/urea hybrids, olefin-based copolymer ionomer compositions, polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers;

styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, available from Arkema Inc; cross-linked trans-polyisoprene and blends thereof; polyester-based thermoplastic elastomers, such as Hytrel®, available from DuPont; polyurethane-based thermoplastic elastomers, such as Elastollan®, available from BASF; polycarbonate/polyester blends such as Xylex®, available from SABIC Innovative Plastics; maleic anhydride-grafted polymers such as Fusabond®, available from DuPont; and mixtures of the foregoing materials.

In addition, the polyurethane compositions may contain fillers, additives, and other ingredients that do not detract from the properties of the final composition. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives. Other suitable additives include antioxidants, stabilizers, softening agents, plasticizers, including internal and external plasticizers, impact modifiers, foaming agents, density-adjusting fillers, reinforcing materials, compatibilizers, and the like. Some examples of useful fillers include zinc oxide, zinc sulfate, barium carbonate, barium sulfate, calcium oxide, calcium carbonate, clay, tungsten, tungsten carbide, silica, and mixtures thereof. Rubber regrind (recycled core material) and polymeric, ceramic, metal, and glass microspheres also may be used. Generally, the additives will be present in the composition in an amount between about 1 and about 70 weight percent based on total weight of the composition depending upon the desired properties.

Intermediate Layers

In one preferred embodiment, an intermediate layer is disposed between the single or multi-layered core and surrounding cover layer. These intermediate layers also can be referred to as casing or mantle or inner cover layers. The intermediate layer can be formed from any materials known in the art, including thermoplastic and thermosetting materials, but preferably is formed of an ionomer composition comprising an ethylene acid copolymer containing acid groups that are at least partially neutralized. Suitable ethylene acid copolymers that may be used to form the intermediate layers are generally referred to as copolymers of ethylene; $C_3$ to $C_8$ α, β-ethylenically unsaturated mono- or dicarboxylic acid; and optional softening monomer. These ethylene acid copolymer ionomers also can be used to form the inner core and outer core layers as described above. In other embodiments, these thermoplastic ionomer compositions can be used to make the golf ball cover.

Suitable ionomer compositions include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70% of all acid groups present in the composition are neutralized. Preferred ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid monoester, ethylene/maleic acid, ethylene/maleic acid mono-ester, ethylene/(meth)acrylic acid/n-butyl (meth)acrylate, ethylene/(meth)acrylic acid/isobutyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Preferred α, β-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

In a particularly preferred version, highly neutralized E/X- and E/X/Y-type acid copolymers, wherein E is ethylene, X is a $C_3$-$C_8$ α,β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene in the acid copolymer is typically at least 15 wt. %, preferably at least 25 wt. %, more preferably least 40 wt. %, and even more preferably at least 60 wt. %, based on total weight of the copolymer. The amount of $C_3$ to $C_8$ α, β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals.

Other suitable thermoplastic polymers that may be used to form the intermediate layer include, but are not limited to, the following polymers (including homopolymers, copolymers, and derivatives thereof: (a) polyester, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly(ethylene naphthenate), and those disclosed in U.S. Pat. Nos. 6,353,050, 6,274,298, and 6,001,930, the entire disclosures of which are hereby incorporated herein by reference, and blends of two or more thereof; (b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof; (c) polyurethanes, polyureas, polyurethane-polyurea hybrids, and blends of two or more thereof; (d) fluoropolymers, such as those disclosed in U.S. Pat. Nos. 5,691,066, 6,747,110 and 7,009,002, the entire disclosures of which are hereby incorporated herein by reference, and blends of two or more thereof; (e) polystyrenes, such as poly(styrene-co-maleic anhydride), acrylonitrile-butadiene-styrene, poly(styrene sulfonate), polyethylene styrene, and blends of two or more thereof; (f) polyvinyl chlorides and grafted polyvinyl chlorides, and blends of two or more thereof; (g) polycarbonates, blends of polycarbonate/acrylonitrile-butadiene-styrene, blends of polycarbonate/polyurethane, blends of polycarbonate/polyester, and blends of two or more thereof; (h) polyethers, such as polyarylene ethers, polyphenylene oxides, block copolymers of alkenyl aromatics with vinyl aromatics and polyamicesters, and blends of two or more thereof; (i) polyimides, polyetherketones, polyamideimides, and blends of two or more thereof; and (j) polycarbonate/polyester copolymers and blends.

Golf Ball Construction

The core layers for disclosed golf balls may be made using any suitable conventional technique such as, for example, compression or injection-molding. Typically, the cores are formed by compression molding a slug of uncured or lightly cured rubber material into a spherical structure. Prior to forming the cover layer, the core structure may be surface-treated to increase the adhesion between its outer surface and adjacent layer. Such surface-treatment may include mechanically or chemically-abrading the outer surface of the core. For example, the core may be subjected to corona-discharge, plasma-treatment, silane-dipping, or other treatment methods known to those in the art.

As discussed above, an inner cover layer or intermediate layer, preferably formed from an ethylene acid copolymer ionomer composition, can be formed between the core or ball sub-assembly and cover layer. The intermediate layer comprising the ionomer composition may be formed using a conventional technique such as, for example, compression or injection-molding. For example, the ionomer composition may be injection-molded or placed in a compression mold to produce half-shells. These shells are placed around the core in a compression mold, and the shells fuse together to form an intermediate layer. Alternatively, the ionomer composition is injection-molded directly onto the core using retractable pin injection-molding.

Figure 2:
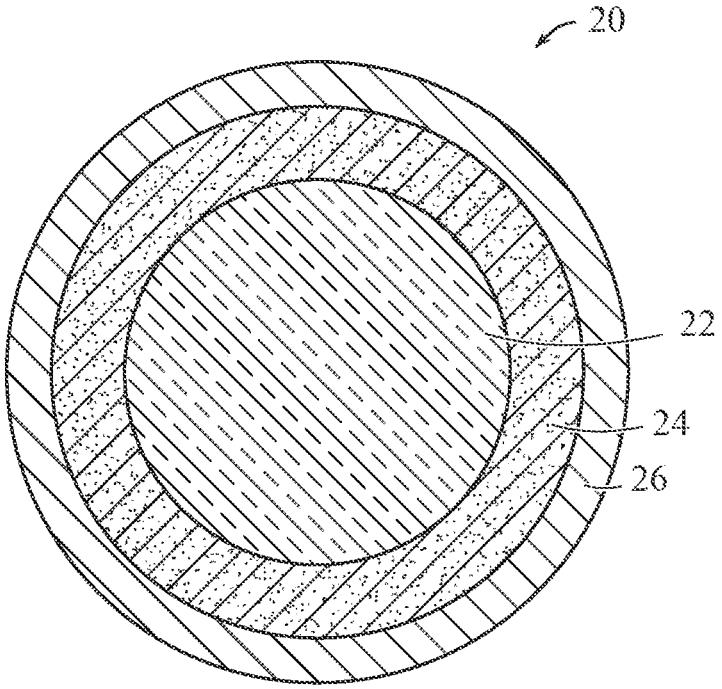
FIG. 2 is a cross-sectional view of a three-piece golf ball in accordance with an embodiment of the present disclosure.
Figure 3:
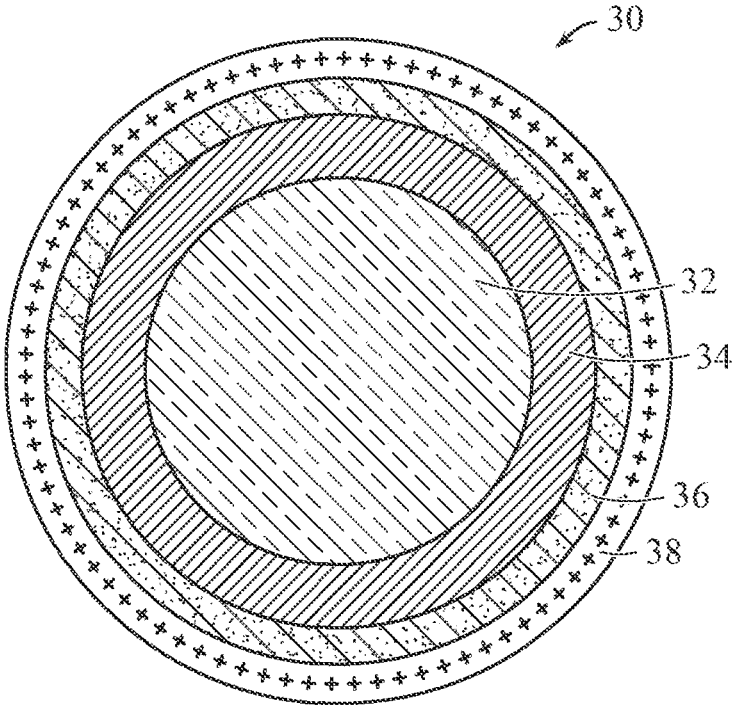
FIG. 3 is a cross-sectional view of a four-piece golf ball in accordance with an embodiment of the present disclosure.
Figure 4:
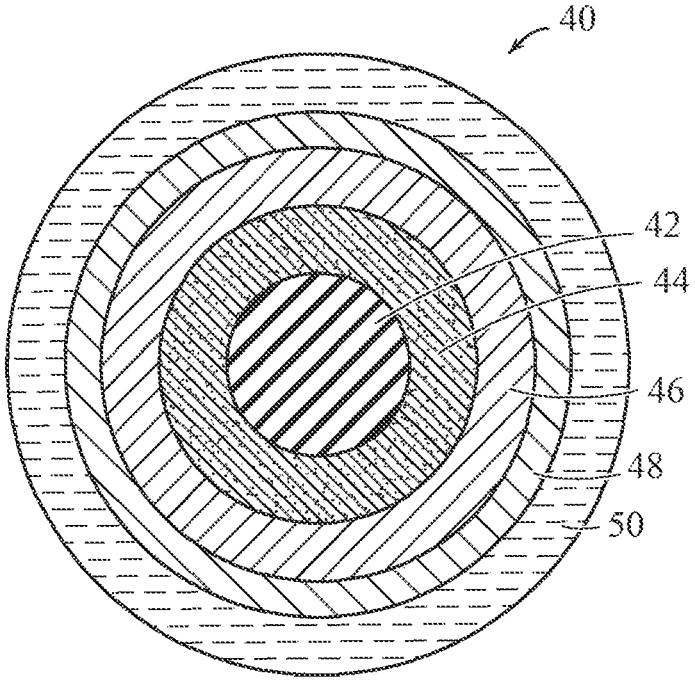
FIG. 4 is a cross-sectional view of a five-piece golf ball in accordance with an embodiment of the present disclosure.

In one embodiment, a golf ball of the present disclosure is a one-piece ball where the core and cover form a single integral layer. In another version, shown in FIG. 1, a golf ball of the present disclosure is a two-piece ball 10 comprising a single core layer 12 and a single cover layer 14. As shown in FIG. 2, in one embodiment, the golf ball 20 comprises a core layer 22, an intermediate layer 24, and a cover layer 26. In FIG. 2, the intermediate layer 24 can be considered an outer core layer, an inner cover layer, a mantle or casing layer, or any other layer disposed between the core 22 and the cover layer 26. Referring to FIG. 3, in another embodiment, a four-piece golf ball 30 comprises an inner core layer 32, an outer core layer 34, an intermediate layer 36, and an outer cover layer 38. In FIG. 3, the intermediate layer 36 may be considered a casing or mantle layer, or inner cover layer, or any other layer disposed between the outer core layer 34 and the outer cover of the ball 38. Referring to FIG. 4, in another version, a five-piece golf ball 40 comprises a three-layered core having an inner core layer 42, an intermediate core layer 44, an outer core layer 46, an inner cover layer 48, and an outer cover layer 50. As exemplified herein, a golf ball in accordance with the present disclosure can comprise any combination of any number of core layers, intermediate layers, and cover layers.

The golf balls of this invention provide the ball with a variety of advantageous mechanical and playing performance properties as discussed further below. In general, the hardness, diameter, and thickness of the different ball layers may vary depending upon the desired ball construction. If the ball includes an intermediate layer or inner cover layer, the hardness (material) is about 50 Shore D or greater, more preferably about 55 Shore D or greater, and most preferably about 60 Shore D or greater. In one embodiment, the inner cover has a Shore D hardness of about 62 to about 90 Shore D. In one example, the inner cover has a hardness of about 68 Shore D or greater. In addition, the thickness of the inner cover layer is preferably about 0.015 inches to about 0.100 inches, more preferably about 0.020 inches to about 0.080 inches, and most preferably about 0.030 inches to about 0.050 inches.

The manufacturing methods and molds of this invention may be used to mold relatively thin outer covers, for example covers having a thickness of less than 0.075 inches, more preferably 0.050 inches and below, preferably 0.040 inches and below, more preferably 0.030 inches and below, and most preferably 0.025 inches and below.

More particularly, the outer cover preferably has a thickness within a range having a lower limit of about 0.004 or 0.010 or 0.020 or 0.030 or 0.040 inches and an upper limit of about 0.050 or 0.055 or 0.065 or 0.070 or 0.080 inches. Most preferably, the thickness of the outer cover is about 0.025 inches or less. The outer cover preferably has a surface hardness of 65 Shore D or less, or 55 Shore D or less, or 50 Shore D or less, or 50 Shore D or less, or 45 Shore D or less. Preferably, the outer cover has hardness in the range of about 20 to about 59 Shore D. In one example, the outer cover has hardness in the range of about 25 to about 55 Shore D.

The United States Golf Association ("USGA") has set total weight limits for golf balls. Particularly, the USGA has established a maximum weight of 45.93 g (1.62 ounces) for golf balls. There is no lower weight limit. In addition, the USGA requires that golf balls used in competition have a diameter of at least 1.68 inches. There is no upper limit so many golf balls have an overall diameter falling within the range of about 1.68 to about 1.80 inches. The golf ball diameter is preferably about 1.68 to 1.74 inches, more preferably about 1.68 to 1.70 inches. In accordance with the present invention, the weight, diameter, and thickness of the core and cover layers may be adjusted, as needed, so the ball meets USGA specifications of a maximum weight of 1.62 ounces and a minimum diameter of at least 1.68 inches.

Unique Effect Pigments

In general, golf balls with unique pigments and methods to manufacture golf balls with unique pigments are described herein. The apparatus, methods, and articles of manufacture described herein are not limited in this regard.

In some embodiments, a golf ball includes one or more layers having a thermochromic or photochromic ink composition. An exemplary golf ball uses unique pigments, such as flakes and/or dyes (or other substrates referred to herein simply as pigments) that are solar sensitive, color shifting, and/or temperature sensitive, providing unique finishes for golf equipment and golf ball coatings. For example, disclosed embodiments include color-shifting cover compositions for golf balls. It should be understood that disclosed features may also be applied to paints and inks that are used as coatings for golf balls or other golf equipment. This disclosure addresses an opportunity to explore colorants that provide properties such as color shift depending on change due to temperature change, iridescent colors, and combinations thereof. The colorant itself includes properties such as a visible shift in color based on a change in at least one of incidence of light, temperature, or pressure which carries through to the golf ball. For example, the colorant may include a plurality of flakes that exhibit a reversible color change property. The resulting golf ball includes a unique effect that may enhance a performance parameter of the golf ball, such as identification, alignment, visibility, etc.

In disclosed embodiments, colorants such as a plurality of flakes added to a cover material may be configured to shift color based on a change in at least one of incidence of light, temperature, or pressure. In some embodiments, the color shift may be a reversible color shift the results in a different appearance of the golf ball even given a fixed point of observation. For example, thermochromic and/or photochromic materials may be used. Thermochromic materials change color with a change in temperature. Photochromic materials change color with a change in incident light.

As described, a golf ball comprising a unique-effect pigment may experience a color shift. In some non-limiting examples, the color shift may be characterized as fluorescent, holographic, iridescent, or pearlescent. For example, flakes may be selected and incorporated into a golf ball based on their visual properties being one or more of fluorescent, holographic, iridescent, or pearlescent, as these terms are understood in the art of pigments and color effects.

Color shift in a finished golf ball can also be quantified using colorimetry. Colorimetry measurements may include, for example, spectral measurements (e.g., the appearance of a color through a light measurement), kinetic measurements (e.g., a determination of a halftime of color change in a manner known in the art), or other quality measurements. In some embodiments, colorimetry measurements may use a color coordinate system, such as those known in relation to the CIELAB color space (e.g., L*, a*, b*, C* and h°). A change in color may be understood as a threshold deviation in a color coordinate (e.g., average deltas (change in) lightness (DL*cmc), chroma (DC*cmc), hue (DH*cmc) and "distance" between two colors (DE*cmc) may be derived using color coordinate measurements.

Colorimetry may be used to determine and quantify a difference (or distance) between two colors in a color shifting appearance of a golf ball having thermochromic and/or photochromic unique-effect pigments. For example, golf balls having disclosed pigments may exhibit a color shift including a change color resulting in a dEcmc (or dEab) of at least 1 when comparing values measured before and after a 1° C. temperature change. In one example, a degree of color shift is linear. For example, the color shift may include a dEcmc of at least 2 when comparing values measured before and after a 2° C. temperature change, at least 5 when comparing values measured before and after a 5° C. temperature change, and/or at least 10 when comparing values measured before and after a 10° C. temperature change. In another example, the degree or ratio of color shift to temperature is non-linear (e.g., as temperature continues to increase at a constant rate, the color shift increases or decreases at a different average rate). Another embodiment of this disclosure includes pigments used in golf balls that change color resulting in a dEcmc (or dEab) of at least 1 when comparing values measured before and after an exposure to a threshold amount of light (e.g., at least 1, 100, 1000, etc. $W/m^2$) in the 400-700 nm range.

Embodiments of the present disclosure may include a cover material mixed with a colorant. The cover material may be a thermoset polyurethane, a cast urethane, or an ionomer material. The cover material may be transparent, translucent, or opaque. The cover material may be white or non-white. A cover material with one or more of these visible properties (transparent, white, non-white, etc.) may be selected to enhance the effect of a color-shifting cover having both a cover material and a colorant. The colorant may be one or more of flakes, pigment(s), or dye(s). The colorant itself (i.e., before being mixed with the cover material) may include a unique effect as described herein—such as a the ability to produce a reversible color change. The reversible color change may be based on the physical color-shifting properties of the colorant added to the cover material. The resulting color-shifting cover of a golf ball includes a visible shift in color based on a change in at least one of incidence of light, temperature, or pressure.

A golf ball having a color-shifting cover may include a visible appearance that shifts among at least two different colors. In another embodiment, the visible appearance of a color-shifting cover may shift among at least three different colors. These colors may include, for example, at least three of blue, green, gold, red, purple, orange, violet, yellow, and white.

Another embodiment of this disclosure includes golf equipment which may include one or more effect pigments added to a coating or cover, wherein the effect pigments change appearance with exposure to external stimuli.

Another embodiment of this disclosure includes golf equipment which may include one or more effect pigments added to a coating or cover, wherein the effect pigments change appearance with exposure to change in temperature.

Another embodiment of this disclosure includes golf equipment which may include one or more effect pigments added to a coating or cover, wherein the effect pigments change appearance with exposure to change in pressure.

Another embodiment of this disclosure includes golf equipment which may include one or more effect pigments added to a coating or cover, wherein the effect pigments change appearance with exposure to light.

In another embodiment, a thermochromic ink composition may include a) a thermochromic aqueous slurry, and b) an ink vehicle selected from the group consisting of 1) a phenolic modified rosin and an oil compatible with the rosin, 2) at least one styrene maleic anhydride resin and a glycol, or 3) an acrylic resin varnish. While not wishing to be bound to any specific theory or mechanism, it is believed that the enhanced toner adhesion provided by the ink composition results from the use of an ink vehicle containing either a phenolic modified rosin, a maleic anhydride resin, or an acrylic resin.

The ink vehicle for use in the claimed device may include a phenolic modified rosin (modified with formaldehyde and pentaerythritol) and an oil which is compatible with the rosin. A phenolic modified rosin is avail-able from Akzo Nobel Resins, Mendham, N.J., under the designation SPR-10. Suitable compatible oils include tall oil and linseed oil. The tall oil is a tall oil fatty acid ester available from Arizona Chemical, Panama City, Fla., under the designation SYL-FAT® 9012. The linseed oil is an alkali refined linseed oil obtained from Degen Oil Chemical, Jersey City, N.J., under the designation P-1037 Supreme Linseed oil.

An alternative ink vehicle which is suitable for use in the claimed device may include at least one styrene maleic anhydride resin and a glycol. Styrene maleic anhydride resin vehicles are commercially available from Kustom Blending, Inc., Florence Ky. under the designations KS-153 and KS-100. Such vehicles comprise styrene maleic anhydride resins dissolved in glycol with a small amount of amine. The KS-100 vehicle further includes urea.

When such vehicles are used, the ink composition further includes an amount of propylene glycol and optionally, an amine, triethanolamine.

Another alternative ink vehicle which may be used in the thermochromic composition of the claimed device is an acrylic resin varnish. A acrylic resin varnish is commercially available from Ron Ink under the designation "Laser Safe Sheet-fed Varnish-24809 MQ5" and includes an acrylic resin, an aliphatic oil, a pigment or filler, wax, and soybean oil. When such a vehicle is used, the ink composition further includes an amount of the styrene-maleic anhydride resin vehicle described above, an amine, and an oil such as linseed oil and/or soybean oil.

The thermochromic aqueous slurry included in the ink composition may be obtained from a number of commercial suppliers and may include particles of an encapsulated thermochromic pigment dispersed in a water-based slurry. A thermochromic aqueous slurry for use in the claimed device is commercially available from Neil Brothers Ltd., Birmingham, United Kingdom, under the designation AQ Type 25 or AQ Type 42. The aqueous slurry may be formulated so as to provide a variety of color changes. Preferably, the thermochromic aqueous slurry provides a reversible color change from colored to colorless which occurs at a temperature range of between about 85° F. and 125° F. Depending on the dyes included in the thermochromic slurry, the color change may be from a first color to a second color. For example, by adding a non-thermochromic yellow dye with a thermochromic red slurry, the color appears orange at ambient temperature, then changes to yellow at elevated temperatures. By mixing blue thermochromic slurry with a non-thermochromic yellow dye, a color change will occur from green to yellow. By mixing blue thermochromic slurry with a non-thermochromic red dye, the color change will be from purple to red. A variety of other thermochromic aqueous slurries can be mixed with non-thermochromic dyes as described above to cause a color to color change. Such slurries include blue, gray, pink, red, orange and purple.

The thermochromic ink composition is made by first preparing the ink vehicle, then adding the pre-mixed thermochromic aqueous slurry to the ink vehicle. In a method, a solution of phenolic modified rosin is prepared at 52-53% concentration in a tall oil fatty acid ester. The liquid tall oil fatty acid ester is added to a kettle at room temperature and then heated to 135-140° C. while the phenolic modified rosin is slowly added with stirring. Once in solution, the hot mixture is filtered through 150 micron mesh and cooled. The thermochromic aqueous slurry is then added to the resin solution while mixing, which solution is warmed to about 55° C.

The thermochromic ink composition is generally applied to a golf ball substrate by any suitable printing process. Letterpress processes permit greater quantities of ink to be applied to a substrate than lithographic processes, resulting in more vibrant, contrasting color responses. Spray printing is also a convenient method. The composition may be applied in selected areas which can form blocks of color, or they may be applied so as to form images, numbers, letters, symbols, or other indicia. The composition may be selectively printed on the surface of golf equipment during the manufacturing process, and may be applied to one or both sides of the substrate. The substrate may comprise any suitable golf equipment including golf balls, golf shoes, golf clubs, golf tees, and golf clothing.

Another embodiment of this disclosure includes golf equipment which may include one or more effect pigments added to a coating or cover, wherein the effect pigments comprise one or more of the following compounds and dyes, and composites, complexes, hydrogels, matrices, and films thereof: poly(lactic acid) (PLA); polystyrene (PS); poly(N-isopropylacrylamide) (PNIPAM); polyether; poly(ethylene terephthalate glycol); poly(ethylene terephthalate); poly(methyl methacrylate); poly(methylmethacrylate-co-butylmethacrylate); poly(butyl methacrylate); poly(ethylene-co-norbornene); poly(ethylene; glycol) (PEG); poly (methylmethacrylate) (PMMA); poly(methacrylic acid); poly(ethylacrylate); poly(N,N-diethylacrylamide); poly[styrene-block-poly(methacrylic acid); poly(styrene-b-isoprene) (PS-b-PI); poly(dodecylglyceryl itaconate) (PDGI); poly (acrylamide) (PAAm); poly(acrylic acid) (PAAc); poly(p-methyl styrene) (PpMS); poly(N-isopropylacrylamide-co-acrylic acid) (PNIPAM-co-PAAc); poly(N-isopropylacrylamide-co-glycidylmethacrylate) (PNIPAM-co-PGMA); poly(N,N-diethylacrylamide-co-N-ethylacrylamide-co-2-hydroxyethyl methacrylate; poly(N-isopropylacrylamide-co-acrylic acid); N,N'-methylenebisacrylamide; poly(ethylene glycol) ethyl ether methacrylate; poly(ethylene glycol) methyl ether methacrylate; poly(benzylmethacrylate) (PBMA); 4-acryloylaminoazobenzene; N-isopropyl-acrylamide; Nafion (a perfluorosulfonate ion exchange polymer); safranin-O; phenolphthalein; methylene blue; borax; poly(1-vinyl-3-ethylimidazolium)bis-(trifluoromethanesulfonimide); N-isopropylacrylamide; glycidyl methacrylate; N,N'-methylene-bis-acrylamide; cresol red-3-(N,N-dimethyl-N-dodecylammonio) propanesulfonate; 1,4-bis(α-cyano-4-octadecyloxystyryl)-2,5-dimethoxybenzene (Cyano OPV I); 2-(4-[2-(4-ethoxy-phenyl)-vinyl]-phenyl)-3-(4-(2-(4-[2-(4-ethoxy-phenyl)-vinyl]-phenyl)-2-isocyano-vinyl)-2,5-bis-octyloxy-phenyl]-acrylonitrile (Cyano OPV II); 1,4-bis(α-cyano-4-methoxystyryl)-benzene (Cyano OPV III); 4,4'-bis (2-benzoxazolyl)stilbene (BBS); N,N'-bis(2-(1-piperazino) ethyl]-3,4,9,10-perylenetetracarboxylic acid diimide dichloride (PZPER); N,N'-bis-(R)-(1-phenylethyl)-perylene-3,4,9,10-tetracarboxyldiimide (R-Pery); anthocyanidin; cyanidin; pelargonidin chloride; cyanidin chloride (E163); delphinidin chloride; dodecyl gallate (E312); and hexadecanoic acid (E570).

Another embodiment of this disclosure includes golf equipment which may include one or more effect pigments added to a coating or cover, wherein the effect pigments comprise the following chemical composition: PLA; cyanidin chloride; dodecyl gallate; and hexadecanoic acid.

Another embodiment of this disclosure includes golf equipment which may include one or more effect pigments added to a coating or cover, wherein the effect pigments comprise the following ranges (about) of chemical compositions: 0.1-1000 g PLA; 0.1-100 mg cyanidin chloride; 0.1-10 g dodecylgallate; and 0.1-10 g hexadecanoic acid.

Another embodiment of this disclosure includes golf equipment which may include one or more effect pigments added to a coating or cover, wherein the effect pigments comprise the following ranges (about) of chemical compositions: 10-100 g PLA; 1-100 mg cyanidin chloride; 1-10 g dodecylgallate; and 1-10 g hexadecanoic acid.

Another embodiment of this disclosure includes golf equipment which may include one or more effect pigments added to a coating or cover, wherein the effect pigments comprise the following ranges (about) of chemical compositions: 70-80 g PLA; 10-20 mg cyanidin chloride; 3-5 g dodecylgallate; and 1-5 g hexadecanoic acid.

Another embodiment of this disclosure includes golf equipment which may include one or more effect pigments added to a coating or cover, wherein the effect pigments comprise the following chemical composition (about): 75 g PLA; 16 mg cyaniding chloride; 4 g dodecyl gallate; and 4.4 g hexadecanoic acid.

Another embodiment of this disclosure includes golf equipment which may include one or more effect pigments added to a coating or cover, wherein the effect pigments comprise the following chemical composition (about): 75 g PLA; 16 mg cyaniding chloride; 4 g dodecyl gallate; and 1.9 g hexadecanoic acid.

Another embodiment of this disclosure includes golf equipment which may include one or more effect pigments added to a coating or cover, wherein the effect pigments are mixed into an outer polyurethane cover material.

Another embodiment of this disclosure includes golf equipment which may include a thermochromic ink composition with effect pigments.

Another embodiment of this disclosure includes golf equipment which may include a thermochromic ink composition with effect pigments, wherein the golf equipment is one or more golf balls.

Another embodiment of this disclosure includes golf equipment which may include a thermochromic ink composition with effect pigments, wherein the thermochromic ink composition may include: a thermochromic aqueous slurry; and an ink vehicle selected from the group consisting of: a phenolic modified rosin and an oil compatible with said rosin; at least one styrene maleic anhydride resin and a glycol; or an acrylic resin varnish in combination with a styrene maleic anhydride resin vehicle.

Another embodiment of this disclosure includes golf equipment which may include a thermochromic ink composition with effect pigments, wherein the thermochromic ink composition may include the following chemical composition: a thermochromic aqueous slurry; a phenolic modified rosin; tall oil; and linseed oil.

Another embodiment of this disclosure includes golf equipment which may include a thermochromic ink composition with effect pigments, wherein the thermochromic ink composition may include the following ranges (about) of chemical compositions: 20-45% thermochromic aqueous slurry; 25-50% phenolic modified rosin; 25-45% tall oil; and 0-25% linseed oil.

Another embodiment of this disclosure includes golf equipment which may include a photochromic ink composition with effect pigments.

Another embodiment of this disclosure includes golf equipment which may include a photochromic ink composition with effect pigments, wherein the golf equipment is one or more golf balls.

Another embodiment of this disclosure includes golf balls which may include a photochromic ink composition with effect pigments, which may include photochromic units which may include azobenzene, diarylethene, phenoxynaphthacenequinone, spiropyran and spirooxazine, and further including one or more polymer matrices which may include poly(vinyl butyral) (PVB), polystyrene (PS), styrene/allyl alcohol copolymer (SAA), and 1,2-polybutadiene (PBD).

Generally, photochromic polymers are composed of photochromic units and a polymer matrix.

Typical examples of photochromic units include azobenzene, diarylethene, phenoxynaphthacenequinone, spiropyran and spirooxazine.

Typical examples of polymer matrices include poly(vinyl butyral) (PVB), polystyrene (PS), styrene/allyl alcohol copolymer (SAA), and 1,2-polybutadiene (PBD).

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

The invention claimed is:

1. A golf ball, comprising:

a color-shifting cover surrounding a core, wherein the color-shifting cover comprises a cover material mixed with a colorant, wherein the cover material comprises at least one of a thermoset polyurethane, cast urethane, or ionomer material, wherein the colorant comprises one or more of a flake, pigment, or dye that shift between at least three colors, wherein the color-shifting cover changes color based on a change in at least one of incidence of light, temperature, or pressure; and wherein the colorant comprises a chemical composition including:

a. PLA;

b. cyanidin chloride;

c. dodecyl gallate; and d. hexadecanoic acid.

2. The golf ball of claim 1, wherein the cover material is transparent.

3. The golf ball of claim 1, wherein the cover material is white.

4. The golf ball of claim 1, wherein the cover material is non-white.

5. The golf ball of claim 1, wherein the colorant comprises a plurality of flakes mixed with the cover material, wherein the plurality of flakes exhibit a reversible color change property.

6. The golf ball of claim 5, wherein the flakes are thermochromic.

7. The golf ball of claim 6, wherein the color-shifting cover produces a linear color shift such that a first temperature change results in a first delta E color change effect, and a second temperature change that is twice the first temperature change results in a second delta E color change effect that is twice the first delta E color change effect.

8. The golf ball of claim 7, wherein the color-shifting cover produces a color shift including a change color resulting in a delta E of at least 2 when comparing values measured before and after a 2° C. temperature change, at least 5 when comparing values measured before and after a 5° C. temperature change, and at least 10 when comparing values measured before and after a 10° C. temperature change.

9. The golf ball of claim 5, wherein the flakes are photochromic.

10. The golf ball of claim 9, wherein the color-shifting cover produces a color shift including a change color resulting in a delta E of at least 1 when comparing values measured before and after exposure to a threshold amount of light in the 400-700 nm range.

11. The golf ball of claim 5, wherein the flakes are at least one of fluorescent, holographic, iridescent, or pearlescent.

12. The golf ball of claim 8, wherein the at least three colors include at least three of blue, green, gold, red, purple, orange, violet, yellow, and white.

13. A golf ball, comprising:

a color-shifting cover surrounding a core, wherein the color-shifting cover comprises a cover material mixed with a colorant, wherein the cover material comprises at least one of a thermoset polyurethane, cast urethane, or ionomer material, wherein the colorant comprises one or more of a flake, pigment, or dye, wherein the color-shifting cover includes a visible shift in color based on a change in at least one of incidence of light, temperature, or pressure, and wherein the colorant comprises a chemical composition including:

a. PLA;

b. cyanidin chloride;

c. dodecyl gallate; and d. hexadecanoic acid.

* * * * *